United States Patent [19]

Yamagata et al.

[11] 4,282,047

[45] Aug. 4, 1981

[54] METHOD OF PRODUCING STEEL PIPE MATERIAL FOR OIL WELL

[75] Inventors: Mitsukuni Yamagata, Chiba; Keiichiro Takitani, Nagoya; Sadao Hasuno, Chita; Kuniaki Motoda, Chiba, all of Japan

[73] Assignee: Kawasaki Steel Corporation, Hyogo, Japan

[21] Appl. No.: 70,905

[22] Filed: Aug. 29, 1979

[51] Int. Cl.[3] ..... C21D 1/18

[52] U.S. Cl. ..... 148/143; 148/36

[58] Field of Search ..... 148/143, 144, 36

[56] References Cited

U.S. PATENT DOCUMENTS 3,992,231 11/1976 Timmons ..... 148/143

*Primary Examiner*—R. Dean

*Attorney, Agent, or Firm*—Koda and Androlia

[57] ABSTRACT

The method of producing steel pipe material for an oil well is characterized in that, as for the chemical composition of steel, B contained steel is adopted avoiding the addition of Ti which increases the values of non-metallic inclusions to decrease machinability, the value of N is limited to not more than 0.003% to be decreased in content of nitrides, coarse crystal grains due to the decreased content of N are prevented through austenizing of steel under rapid heating, so that such a steel pipe material for an oil well can be obtained that which has resistance to sulfide stress corrosion in addition to satisfactory strength and machinability..

2 Claims, 1 Drawing Figure

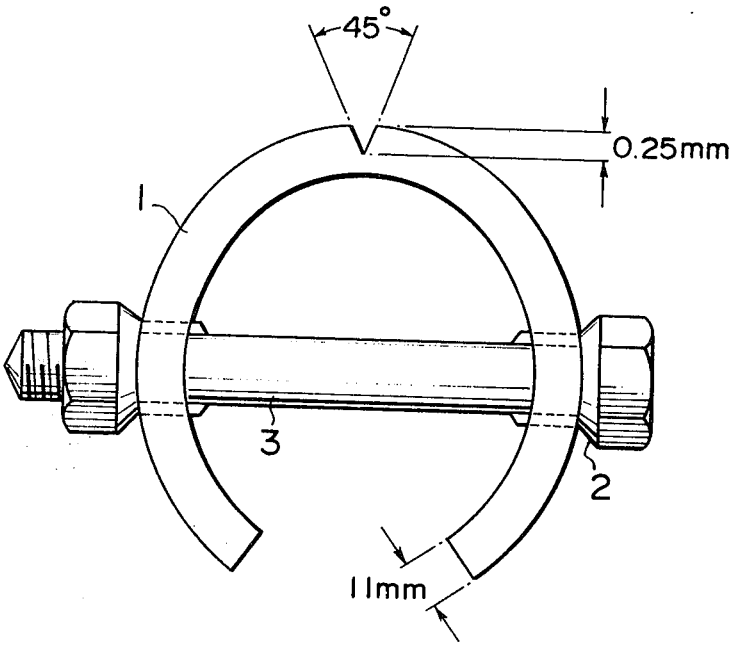
45°
0.25mm
1
3
2
11mm

METHOD OF PRODUCING STEEL PIPE MATERIAL FOR OIL WELL

BACKGROUND OF THE INVENTION

1. Field of the Invention

This invention relates to a method of producing steel pipe material for an oil well, and particularly to steel pipe material excellent in resistance to sulfide stress corrosion for a sour oil well or a gas well.

2. Description of the Prior Art

High strength and high corrosion resistance are required from the steel pipes for an oil well or gas well depending upon the depth, degree of acidity and the like. Recently, there has been a tendency that the depths of oil wells everywhere in the world are increased more and more, with the result that steel pipes of high strength have been demanded to be supplied. At the same time, with the oil wells of acidity having high content of sulfides such as hydrogen sulfide, properties resistant to stress corrosion of said sulfides are required from the steel pipes.

There has heretofore been known such a relationship that said resistance to sulfide stress corrosion is inversely proportional to the increase in strength of the steel, i.e. the resistance to sulfide stress corrosion is decreased with the increase in strength of the steel pipe.

There has been disclosed an invention of Japanese Patent Application Laid-Open (Kokai) No. 52114/77 as the prior art of producing steel pipe material of high strength and having resistance to sulfide stress corrosion for an oil well. This steel is introduced thereinto with Boron (B). Because B loses its effects when forming a nitride, Titanium (Ti) having a strong trend of producing a nitride is added at the same time. However, Ti has a high affinity with oxygen, whereby the amount of non-metallic inclusions are increased, thus presenting such a disadvantage that machinability of the steel pipe for an oil well in the threading process is considerably deteriorated.

SUMMARY OF THE INVENTION

One object of the present invention is to provide a method of producing steel pipe material for an oil well, wherein said conventional disadvantage of the steel pipe material for an oil well is obviated, the relationship that the resistance to sulfide stress corrosion is inversely proportional to the increase in strength of the steel is overcome and the high strength and high resistance to sulfide stress corrosion are consistently held.

The abovedescribed object of the present invention can be achieved by two methods that have the following technical gists, respectively.

The technical gist of the first method according to the present invention resides in a method of producing steel pipe material for an oil well, comprising the steps of:

heating at a temperature ranging from the transformation point $Ac_1$ to the transformation point $Ac_3$ plus 50° C. at an average heating rate of 1°-30° C./sec;

a steel having a chemical composition for the steel pipe material containing in weight ratio from 0.15 to 0.50% C., from 0.1 to 1.0% Si, from 0.3 to 1.5% Mn, from 0.003 to 0.10% Al, from 0.0005 to 0.005% B, not more than 0.003% N, the balance being essentially Fe and inevitable impurities;

quenching same at the heating temperature ranging from the transformation point $Ac_3$ plus 50° C. to the crystal grain coarsening initiating temperature; and thereafter, tempering same at a temperature not higher than the transformation point $Ac_1$.

The technical gist of the second method according to the present invention resides in a method of producing steel pipe material for an oil well including the heat treatment process identical with that of the first method for heat treating a steel containing a member or more selected from the group consisting, in weight ratio, of from 0.05 to 1.50% Cr, from 0.05 to 1.0% Mo, from 0.01 to 0.10% Nb, from 0.01 to 0.10% V, from 0.05 to 0.50% Cu in addition to the chemical composition identical with the basic chemical composition of the first method, the balance being essentially Fe and inevitable impurities.

Namely, according to the first method of the present invention, as the measure of decreasing the amount of non-metallic inclusions and improve the machinability such chemical composition of steel is adopted that the steel is made into a B contained steel containing no Ti and less than 0.003% N so as to be improved in hardenability, and at the same time, to be decreased in content of nitrides. Since there is a possibility that the content of aluminum nitrides contributing to increased toughness of the steel is decreased to make crystal grains coarse as the undesirable effect resulted from the content of N thus decreased, by eliminating such possibility as described above, through austenizing the steel under rapid heating, the steel pipe material for an oil well has been obtained which has a satisfactory strength, machinability and resistance to sulfide stress corrosion.

Additionally, the second method of the present invention is intended to further improve the advantages of the present invention by adding to the steel a member or more selected from the group consisting, in weight ratio, of Cr, Mo, Nb, V and Cu in addition to the aforesaid basic chemical composition.

BRIEF DESCRIPTION OF THE DRAWING

The accompanying drawing is a front view showing the test piece of the steel pipe material for an oil well according to the present invention which is used in the tests of sulfide stress corrosion cracking.

DETAILED DESCRIPTION OF THE INVENTION

The chemical composition of the steel pipe material according to the first method of the present invention is as follows:

| | wt. % |
|---|---|
| C: | 0.15-0.50 |
| Si: | 0.1-1.0 |
| Mn: | 0.3-1.5 |
| Al: | 0.003-0.10 |
| B: | 0.0005-0.005 |
| N: | 0.003 or less |

The balance is essentially Fe and inevitable impurities. The reasons for defining the above composition are as follows:

Carbon:

Carbon is one of effective constituents for improving in strength of a steel. However, if the content of C exceeds 0.50% in a steel, the steel has high susceptibility of quench cracking, and when the steel is rapidly heated, Carbon in the steel becomes difficult to dissolve uniformly in the austenite structure, thus resulting in the so-called "uneven hardening". Furthermore, if the content of C is less than 0.15% in the steel, such disadvantages are presented that the steel tends to be reduced in strength and deteriorated in hardenability. Consequently, the content of C is limited within the range from 0.15 to 0.50%.

Silicon:

At least 0.1% of Si is required for better deoxidation and increase in strength of a steel. However, if the content of Si exceeds 1.0%, decrease in toughness of the steel becomes notably high. Consequently, the content of Si is limited within the range from 0.1 to 1.0%.

Manganese:

At least 0.3% of Mn is required for improved strength and toughness and better deoxidation of a steel. However, if the content of Mn exceeds 1.5%, the steel tends to have quench cracking during heat treatment. Consequently, the content of Mn is limited within the range from 0.3 to 1.5%.

Aluminum:

Al is a powerful deoxidizer, is combined with N to form a nitride for improving a steel in toughness, and is added to the composition of a steel for holding the effective amount of B useful for hardenability. Less than 0.003% of Al is ineffective, however, more than 0.1% of Al results in increased aluminum inclusions, and embrittling the steel which comes to have quench cracking. Consequently, the content of Al is limited within the range from 0.003 to 0.10%.

Boron:

A very small content of B notably improves a steel in hardenability, for which purpose at least 0.0005% is required. However, the content of B exceeding 0.005% results in decreased hardenability and toughness. Consequently, the content of B is limited within the range from 0.0005 to 0.005%.

Nitrogen:

N is inevitably mixed into a steel in the process of producing the steel. In order to stably maintain the effects of Boron on improving hardenability, it is necessary to limit the content of N to not more than 0.003%. If the content of N exceeds 0.003%, hardenability is suddenly decreased, thus resulting in incomplete hardening and therefore deteriorated resistance to corrosion.

The second method contemplates that, to facilitate hardenability and tempering resistance of the steel of the present invention, a member or more selected from the group consisting Cr, Mo, Nb, V and Cu are added within the following limit in weight ratio in addition to the limited contents of the first method, thus increasing the advantages of the present invention.

Chromium:

At least 0.05% of Cr is required for improving corrosion resistance and tempering resistance of a steel. If the content of Cr exceeds 1.50% in a steel, such disadvantages are presented that the steel tends to be decreased in toughness and to have quench cracking. Consequently, the content of Cr is limited within the range from 0.05 to 1.50%.

Molybdenum:

At least 0.05% of Mo is required for preventing temper brittleness and improving tempering resistance of a steel. However, if the content of Mo exceeds 1.0%, the steel has an excessively high strength, and has notably decreased toughness. Consequently, the content of Mo is limited within the range from 0.05 to 1.0%.

Niobium, Vanadium:

Both Nb and V are effective in making austenite grains fine and in improving tempering resistance of a steel. Those effects are well displayed at 0.01% and more of the content of Nb or V. However, if the content of Nb or V exceeds 0.1%, said effect is saturated and the toughness if rather decreased. Consequently, the content of Nb or V is limited within the range from 0.01 to 0.10%.

Copper:

Not less than 0.05% of Cu is effective in improving a steel in corrosion resistance. However, if the content of Cu exceeds 0.5%, the steel tends to have cracks due to high temperature. Consequently, the content of Cu is limited within the range from 0.05 to 0.5%.

After steel pipe material for an oil well having the chemical composition as described above is melted, a steel pipe is produced by the conventional method. The temperatures for the heat treatment are determined depending upon the respective constituents.

The steel according to the present invention is heated by induction heating at a temperature ranging from the transformation point $Ac_1$ to the transformation point $Ac_3$ plus 50° C. at an average heating rate of 1°-30° C./sec. Namely, the temperature ranging from the transformation point $Ac_1$ to the transformation point $Ac_3$ plus 50° C. is the range of temperature exerting influence on the size of austenite crystal grains, and it is contemplated to obtain finer crystal grains by rapidly heating the steel within said range of temperature. When the heating rate is less than 1° C./sec, the crystal grains grow coarse, toughness is decreased, further, coarse carbides tend to be precipitated during the succeeding tempering, whereby tempering resistance is weakened, tempering at high temperature becomes impossible and quench cracking due to coarse grains tend to be caused, thus resulting in undesirable conditions. Furthermore, if the heating rate exceeds 30° C./sec, then unstable crystal grain growth develops to hamper the uniformity in structure, which is undesirable. Consequently, according to the present invention, the heating rate is limited within the range from 1° C. to 30° C./sec.

It is desirable for the temperature of quenching to be as high as possible within the range from the transformation point $Ac_3$ plus 50° C. to the crystal grain coarsening initiating temperature. The steel is heated to this temperature range, and quenched in water or oil after the structure is completely austenized.

The steel having martensite thus produced by the quenching can be rendered corrosion-resistant by fully tempering same at a temperature not more than the transformation point $Ac_1$. Internal stress generated in martensite by the quenching is removed by the tempering at high temperture and cementite is spheroidized, so that the steel is improved in toughness as well as in sulfide stress corrosion resistance.

As has been described above, according to the present invention, the chemical composition of the steel is limited and the process of heat treatment is defined, thereby enabling to produce steel pipe material for an oil well excellent in strength and resistance to sulfide stress corrosion.

EXAMPLE

Eight types of steel pipes for oil well according to the present invention are quenched after rapid heating by induction heating, thereafter, tempered by induction heating or gas fired heating. Tests have been made on the machinability, the resistance to corrosion and quench cracking, and at the same time, five other types of steel pipes for oil well which had not met the requirements according to the present invention were subjected to the same method of tests as comparative testing examples. The results are shown in TABLE 1.

TABLE 1

| | No. | C | Si | Mn | P | S | Al | B | N | Cr | Mo | Nb | V | Cu | Ti | Method of heat treatment A | B | C | D | E |
|---|---|---|---|---|---|---|---|---|---|---|---|---|---|---|---|---|---|---|---|---|
| Steel | 1 | 0.21 | 0.31 | 1.46 | 0.011 | 0.009 | 0.035 | 0.0024 | 0.0028 | — | — | — | — | — | — | 24 | 620 | o | o | o |
| of | 2 | 0.32 | 0.24 | 1.21 | 0.026 | 0.009 | 0.031 | 0.0018 | 0.0016 | — | — | — | — | — | — | 24 | 640 | o | o | o |
| the | 3 | 0.31 | 0.26 | 1.36 | 0.018 | 0.011 | 0.086 | 0.0023 | 0.0021 | — | — | — | — | — | — | 24 | 680 | o | o | o |
| Pres- | 4 | 0.28 | 0.22 | 0.51 | 0.011 | 0.018 | 0.059 | 0.0009 | 0.0028 | 0.94 | 0.21 | — | — | — | — | 3 | 700 | o | o | o |
| ent | 5 | 0.26 | 0.33 | 1.15 | 0.019 | 0.007 | 0.028 | 0.0031 | 0.0018 | — | — | 0.031 | — | — | — | 24 | 680 | o | o | o |
| in- | 6 | 0.26 | 0.29 | 1.24 | 0.021 | 0.008 | 0.035 | 0.0021 | 0.0014 | — | — | — | 0.045 | — | — | 24 | 680 | o | o | o |
| ven- | 7 | 0.48 | 0.20 | 0.48 | 0.008 | 0.006 | 0.042 | 0.0034 | 0.0023 | — | — | — | — | — | — | 12 | 660 | o | o | o |
| tion | 8 | 0.46 | 0.18 | 0.34 | 0.012 | 0.009 | 0.039 | 0.0029 | 0.0026 | — | — | — | — | 0.13 | — | 12 | 680 | o | o | o |
| Steel | 9 | 0.26 | 0.21 | 1.18 | 0.016 | 0.010 | 0.031 | 0.0022 | 0.0064 | — | — | — | — | — | — | 0.7 | 580 | o | x | o |
| un- | 10 | 0.29 | 0.24 | 1.31 | 0.019 | 0.008 | 0.029 | 0.0021 | 0.0058 | — | — | — | — | — | 0.026 | 0.7 | 660 | x | o | x |
| der Com- | 11 | | | | | | | | | | | | | | | 24 | 670 | x | o | o |
| par- | 12 | 0.23 | 0.29 | 1.38 | 0.013 | 0.009 | 0.033 | 0.0022 | 0.0032 | — | — | — | — | — | — | 24 | 610 | o | x | o |
| ison | 13 | 0.32 | 0.24 | 1.21 | 0.026 | 0.009 | 0.031 | 0.0018 | 0.0016 | — | — | — | — | — | — | 0.7 | 600 | o | x | x |

Remarks:
A Heating rate (°C./sec)
B Tempering temperature (°C.)
C Machinability
D Corrosion resistance
E Quench cracking In addition, yield strengths of all the steel pipes under test were made even to be 65 Kg/mm$^2$ by the adjustment of tempering temperature and tempering time, and all the steel pipes under tests were quenched at the heating temperature of the transformation point $Ac_3$ plus 150° C. The dimensions of the steel pipes under test were made uniform to be 140 mm in outer diameter and 11 mm in wall thickness.

Machinability was evaluated as follows: in the case said steel pipes under test were machined by an ordinary diehead rotation type threading machine and if tears due to non-metallic inclusions were not caused on the finished surface and the service life of a chaser exceeds 500 cycles corresponding to two times the service life of the chaser used with the steel pipe of the prior art, then the machinability of the steel pipe was evaluated to be satisfactory.

Corrosion resistance was evaluated as follows:

a test piece 1 of 11 mm in thickness, which was V-notched taken from the steel pipe under test as shown in the accompanying drawing, stressed by the tightening of bolt and nut 3 of 10 mm in diameter through resin 2, was immersed for 30 days in an aqueous solution of saturated hydrogen sulfide, containing 0.5% of acetic acid and 5% of sodium chloride and of pH 3–4, and if no cracks were caused thereto even under stress equaling to the yield strength of the pipe at 65 Kg/mm$^2$, then the corrosion resistance was evaluated to be satisfactory.

Further, quench cracking were evaluated by visual observation.

As apparent from TABLE 1, the steel under comparison No. 9 was such an example that, although the steel under comparison No. 9 contained B, B did not effectively contribute to hardenability because the steel contained high value of N but no Ti, therefore a mixed structure consisting martensite and bainite was developed. The steel was low in hardened strength, whereby it was impossible to conduct high temperature tempering to obtain a predetermined strength, the resultant low temperature tempering of 580° C. could not fully temper martensite and heating rate is as low as less than 1° C./sec, thus considerably decreasing the corrosion resistance. Furthermore, with the steel under comparison No. 10, although both Ti and B are contained therein, corrosion resistance was increased but the values of non-metallic inclusions produced are high, whereby machinability was decreased and quench cracking were caused thereto.

With the steels Nos. 1 through 8 according to the present invention, the content of N was regulated, whereby satisfactory hardenability was secured without Ti, separation of carbides scattered into fine particles during tempering was facilitated by grain refining of the material due to rapid heating, it was made possible to conduct high temperature tempering so as to stabilize the strength, thus enabling to produce steel pipe material excellent in machinability, corrosion resistance and causing no quench cracking.

As apparent from the above example, according to the present invention, precious elements such as Ti were not contained, however, the content of N was regulated, a unique method of heat treatment was practised and the following advantages could be obtained.

(a) Corrosion resistance essential for steel pipe material for an oil well, particularly, resistance to sulfide stress corrosion could be improved.

(b) Machinability which had been low in the conventional steel pipe material for an oil well could be improved and quality control and yield in threading work could be improved.

(c) Quench cracking could be completely prevented.

Moreover, the steel pipe material according to the present invention can be effectively used not only as steel pipes for an oil well but also as line pipes and steel material for a chemical plant, both of which require resistance to sulfide stress corrosion cracking.

What is claimed is:

1. A method of producing steel pipe material for an oil well, wherein a steel consisting essentially of in weight ratio from 0.15 to 0.50% C, from 0.1 to 1.0% Si, from 0.3 to 1.5% Mn, from 0.003 to 0.10% Al, from 0.0005 to 0.005% B, not more than 0.003% N, the balance being essentially Fe and inevitable impurities is heated at a temperature ranging from the transformation point $Ac_1$ to the transformation point $Ac_3$ plus 50° C. at an average heating rate of 1°-30° C./sec, quenched at the heating temperature ranging from the transformation point $Ac_3$ plus 50° C. to the crystal grain coarsening initiating temperature, and thereafter, tempered at a temperature not higher than the transformation point $Ac_1$.

2. A method of producing steel pipe material for an oil well, wherein a steel consisting essentially of, in weight ratio, from 0.15 to 0.50% C, from 0.1 to 1.0% Si, from 0.3 to 1.5% Mn, from 0.003 to 0.10% Al, from 0.0005 to 0.005% B, not more than 0.003% N, and further containing a member or more selected from the group consisting, in weight ratio, of from 0.05 to 1.50% Cr, from 0.05 to 1.0% Mo, from 0.01 to 0.10% Nb, from 0.01 to 0.10% V, from 0.05 to 0.50% Cu, the balance being essentially Fe and inevitable impurities is heated at a temperature ranging from the transformation point $Ac_1$ to the transformation point $Ac_3$ plus 50° C. at an average heating rate of 1°-30° C./sec, quenched at the heating temperature ranging from the transformation point $Ac_3$ plus 50° C. to the crystal grain coarsening initiating temperature, and thereafter, tempered at a temperature not higher than the transformation point $Ac_1$.

* * * * *